US006365037B1

(12) United States Patent
Fujihara et al.

(10) Patent No.: US 6,365,037 B1
(45) Date of Patent: Apr. 2, 2002

(54) PRODUCTION PROCESS OF LOW POUR-POINT OIL

(75) Inventors: Kazumitu Fujihara; Yoshiyuki Morishima, both of Saitama (JP)

(73) Assignee: Japan Energy Corporation, Tokyo (JP)

( * ) Notice: Subject to any disclaimer, the term of this patent is extended or adjusted under 35 U.S.C. 154(b) by 0 days.

(21) Appl. No.: 09/211,051

(22) Filed: Dec. 15, 1998

(30) Foreign Application Priority Data

Dec. 26, 1997 (JP) ..... 9-366602

(51) Int. Cl.[7] ..... C10G 73/00
(52) U.S. Cl. ..... 208/24; 268/218; 268/134
(58) Field of Search ..... 208/28, 34, 134

(56) References Cited

U.S. PATENT DOCUMENTS

| | | | | |
|---|---|---|---|---|
| 4,100,056 A | | 7/1978 | Reynolds et al. | |
| 4,137,148 A | | 1/1979 | Gillespie et al. | 208/87 |
| 4,357,232 A | * | 11/1982 | Holland et al. | 208/87 |
| 4,518,485 A | | 5/1985 | LaPierre et al. | |
| 4,597,854 A | * | 7/1986 | Pennock | 208/111 |
| 4,906,350 A | | 3/1990 | Lucien et al. | 208/197 |
| 5,063,187 A | * | 11/1991 | Burgfels | 502/62 |
| 5,139,647 A | | 8/1992 | Miller | 208/100 |
| 5,232,675 A | * | 8/1993 | Shu et al. | 502/64 |
| 5,332,490 A | | 7/1994 | Taylor et al. | |
| 5,376,260 A | * | 12/1994 | Santilli et al. | 208/211 |
| 5,413,695 A | * | 5/1995 | Miller | 208/80 |
| 5,846,402 A | * | 12/1998 | Mandal et al. | 208/113 |

FOREIGN PATENT DOCUMENTS

| | | | |
|---|---|---|---|
| JP | 9-272891 | 10/1997 | C10M/169/04 |
| JP | 9-279160 | 10/1997 | C10G/67/04 |

* cited by examiner

*Primary Examiner*—Helane Myers
(74) *Attorney, Agent, or Firm*—Sughrue, Mion, Zinn, Macpeak & Seas, PLLC

(57) ABSTRACT

A process for producing a low pour-point oil which permits the production of a lower pour point oil without severer hydrodewaxing conditions is disclosed, which comprises hydrodewaxing a mineral oil fraction, which has been separated from a crude oil by distillation and has a boiling point ranging from 250 to 600° C., at a temperature range of from 250° C. to 500° C. in the presence of a zeolite catalyst; and separating a lighter fraction by distillation.

12 Claims, No Drawings

PRODUCTION PROCESS OF LOW POUR-POINT OIL

FIELD OF THE INVENTION

The present invention relates to a process for producing a lubricating base oil or insulating oil from a mineral oil, a mixture of a mineral oil and a long-chain alkylbenzene or the like. In particular, the present invention relates to a process for producing a markedly low pour point oil by separating a lighter fraction by distillation after hydrodewaxing treatment.

BACKGROUND OF THE INVENTION

The insulating oil, lubricating oil and the like are required to have fluidity at low temperatures, because they are sometimes used in a cold district. For example, the pour point of the insulating oil is specified at not higher than −27.5° C. as the first-class No. 2 of JIS C2320 and not higher than −45° C. as Class II of IEC 296.

To secure a low-temperature fluidity, it is necessary to use a wax-free oil, because the wax precipitates at low temperatures. Conventionally, the base oil was produced using as a raw material a naphthene crude oil having a small wax content. The naphthene crude oil is available only from a limited district and is therefore exhausted so that the use of it is disadvantageous in cost. Under such situations, a paraffin crude oil is replaced for the naphthene crude oil, but it requires a wax removal step, that is, dewaxing in advance. For dewaxing, adopted is a solvent dewaxing method wherein the wax precipitated by diluting the paraffin crude oil with a solvent such as methyl ethyl ketone/toluene or the like and then cooling is removed by filtration or a hydrodewaxing method wherein the wax is decomposed and removed by a form-selective zeolite catalyst.

The solvent dewaxing method needs much energy for cooling and removal of the solvent. Particularly when an oil having a pour point not higher than −20° C. is desired, it is necessary to lower the cooling temperature correspondingly. The solvent dewaxing treatment tends to be accompanied with the coloring of an insulating oil so that activated clay treatment for the removal of the color is necessary. Owing to the difficulty in the regeneration of the activated clay after the treatment, it must be disposed as an industrial waste. Under such circumstances, a simple hydrodewaxing method which permits dewaxing at a low cost has attracted attentions.

With regards to the production of an insulating oil by hydrodewaxing, a method which comprises obtaining a raffinate by subjecting a fraction of 232 to 566° C. to solvent extraction, hydrodewaxing the raffinate at 260 to 358° C. and hydro-refining the resulting raffinate at 218 to 316° C. is described in U.S. Pat. No. 4,137,148 which corresponds to JP-A54-22413 (the term "JP-A" as used herein means an "unexamined published Japanese patent application). It says that by this method, a base oil having a pour point not higher than −34.4° C. can be manufactured.

Although the hydrodewaxing treatment is suited for the production of a low pour point oil at a low cost, severer conditions are necessary for producing an oil having a pour point not higher than −35° C. Particularly, the production of an oil having a pour point not higher than −40° C. requires markedly severe treatment conditions and in addition, is accompanied with such a problem of a reduction in the yield of the oil.

SUMMARY OF THE INVENTION

An object of the present invention is to provide a process for producing a low pour point oil which is free of the above-described problems. Specifically, an object of the present invention is to provide a process which permits the production of a low pour point oil without severer hydrodewaxing treatment conditions.

The present inventors have proceeded with various investigations with a view to overcoming the above-described problems. As a result, it has been found that a lighter fraction of the hydrodewaxed mineral oil has a pour point lower than the heavy fraction. As a result of a further investigation, it has also been found that a lower pour point oil can be produced easily by using a fraction up to the point of 80% distillation, leading to the completion of the present invention.

DETAILED DESCRIPTION OF THE INVENTION

The process for producing the oil according to the present invention principally comprises a step of separating from a crude oil a fraction having a boiling point ranging from 250 to 600° C. by distillation; a step of hydrodewaxing the resulting fraction at a temperature range of from 250 to 500° C. in the presence of a zeolite catalyst; a step of removing a fraction having a boiling point not lower than 230° C. but not higher than 250° C.; and a step of separating a lighter fraction up to the point of 80% distillation by distillation.

Since the oil available by the above-described process only is sometimes accompanied with the coloring problem, a hue improving treatment is carried out as needed. For the improvement of the hue, there are two methods; one is the treatment with a solid adsorbent by using, for example, activated clay and the other one is hydrogenating treatment in the presence of a hydro-refining catalyst. The hydro-refining treatment is preferred because the use of activated clay or the like is accompanied with such a problem as the treatment of the adsorbent after use. In the present invention, the hydrodewaxing treatment step is essential so that when a hydro-refining treatment is carried out, the dewaxed mineral oil can be fed continuously to the hydro-refining treatment step as is or after separated by distillation. In this respect, the hydro-refining treatment is preferred.

The production process which has the hydro-refining treatment step added thereto comprises hydrodewaxing a mineral oil fraction, which has been separated from a crude oil by distillation and has a boiling point ranging from 250 to 600° C., at a temperature range of from 250° C. to 500° C. in the presence of a zeolite catalyst; hydrogenating the hydrodewaxed fraction at 320 to 380° C. in the presence of a hydro-refining catalyst; and separating a lighter fraction by distillation. The hydrodewaxed oil may be fed to the hydro-refining treatment step as is or after separated by distillation. This method is suited for the case where the hydro-refining of a heavy fraction is not necessary.

If a nitrogen content in the raw material oil is high and the activity of the zeolite catalyst shows a marked deterioration or if long-term continuous use of the zeolite catalyst is desired, the hydrodewaxing treatment may follow the hydro-refining treatment. Described specifically, such a method comprises hydrogenating a mineral oil fraction, which has been separated from a crude oil by distillation and has a boiling point ranging from 250 to 600° C., at a temperature range of from 320° C. to 380° C. in the presence of a hydro-refining catalyst; hydrodewaxing the resulting fraction at a temperature range of from 250° C. to 500° C. in the presence of a zeolite catalyst; subjecting the hydrodewaxed fraction to hue improving treatment at a temperature range of from 250 to 350° C. in the presence of a hydro-refining catalyst; and separating a lighter fraction by distillation. After the hydrodewaxing treatment, the hydro-refining treatment is carried out at a temperature of 250 to 350° C. for the improvement of the hue. As described above, the hydrodewaxed oil may be fed to the hydro-refining treatment step as is or after separated by distillation.

The process for producing the insulating oil of the present invention will next be described more specifically.

Starting material

As a starting material, a mineral oil which is a fraction separated from a crude oil by distillation and having a boiling point ranging from 250 to 600° C. (in terms of normal pressure) and a viscosity of about 5 to 20 $mm^2/s$ (40° C.) is preferably employed. The mineral oil subjected to solvent extraction as needed and having a viscosity of 50 to 300 $mm^2/s$ (40° C.) can also be employed.

Preparation of a refined mineral oil

The above-described mineral oil fraction is hydrodewaxed at 250 to 500° C. in the presence of a zeolite catalyst. As the hydrodewaxing catalyst, preferred are those obtained by adding a binder to the main component zeolite, for example, pentasil type zeolite, ferrierite or mordenite, which has a silica-alumina ratio of 20:500, and then forming or molding the resulting mixture. Although the hydrodewaxing conditions cannot be determined in a wholesale manner because they are influenced by various factors, the following conditions are usually employed: a temperature of 250 to 500° C., preferably 350 to 450° C., a hydrogen partial pressure of $3.0\times10^6$ to $1.5\times10^7$ Pa (about 30 to 150 $kgf/cm^2$ in terms of gauge pressure), preferably $6.0\times10^6$ to $9.8\times10^6$ Pa (about 60 to 100 $kgf/cm^2$ in terms of gauge pressure), a liquid hourly space velocity (LHSV) of 0.2 to 2.0 $h^{-1}$ and a hydrogen/oil volume ratio of 300 to 3000 l/l, preferably 500 to 1500 l/l. At temperatures lower than 250° C., the hydrodewaxing treatment happens to be incomplete. Temperatures exceeding 500° C., on the other hand, happens to accelerate the decomposition and are therefore not preferred. Anyway, the conditions should be selected so as to finally satisfy a predetermined pour point.

Then, the hydrodewaxed mineral oil fraction is hydrogenated, as is or after separated by distillation into a fraction having a boiling point ranging from 250 to 600° C. (in terms of normal pressure), at a temperature range of 320 to 380° C. in the presence of a hydro-refining catalyst. If the apparatus is designed to carry out the hydrodewaxing and hydro-refining treatments successively, it is preferred that the hydrodewaxed mineral oil is subjected to hydro-refining treatment as is. The distillation operation inserted after the hydrodewaxing treatment sometimes causes a coloring problem due to thermal treatment. Alternatively, the hydro-refining treatment may be carried out after the separation of the hydrodewaxed oil by distillation. The latter method is suited when the hydro-refining treatment of a heavy fraction is unnecessary.

Examples of the hydro-refining catalyst include those having one or more metals selected from Ni, Co, Mo, W and the like supported on a carrier of silica, alumina or silica-alumina. Although the hydro-refining conditions cannot be determined in a wholesale manner because they are influenced by various factors, the following conditions are usually employed: a temperature of 320 to 380° C., a hydrogen partial pressure of $4.5\times10^6$ to $1.2\times10^7$ Pa (about 45 to 120 $kgf/cm^2$ in terms of gauge pressure), preferably $6.0\times10^6$ to $9.9\times10^6$ Pa (about 60 to 100 $kgf/cm^2$ in terms of gauge pressure) and LHSV of 0.2 to 2.0 $h^{-1}$. At temperatures lower than 320° C., the hydro-refining treatment happens to be incomplete. Temperatures exceeding 380° C., on the other hand, happens to accelerate the decomposition and are therefore not preferred. Furthermore, the conditions should be set so that the desulfurization ratio will preferably become at least 95%, more preferably at least 98%; the denitrification ratio will preferably become at least 95%, more preferably at least 98%; and the decomposition ratio will become 5% or lower.

After the hydrogenation treatment, it is possible to carry out solvent extraction refining as needed under the conditions of a raffinate yield of 60 to 90 vol. % by using a solvent which selectively extracts an aromatic hydrocarbon.

As described above, the hydrodewaxing treatment and hydro-refining treatment can be carried out in the reverse order. Particularly in the case where the mineral oil fraction has an extremely high nitrogen content and the activity of a hydrodewaxing catalyst is apt to lower, the reverse order is preferred. The reverse order makes it possible to reduce the catalyst regeneration frequency. When the hydro-refining treatment is carried out in advance, the nitrogen content is reduced which permits the hydrodewaxing treatment at a relatively low temperature. Specifically, the hydrodewaxing temperature can be lowered by about 50° C. compared with the treatment without the preliminary hydro-refining treatment. The mineral oil after the hydrodewaxing treatment however has poor hue so that the hue improving treatment is required. The hue improving treatment is carried out at 250 to 350° C. in the presence of a hydro-refining catalyst. Treatment temperatures lower than 250° C. sometimes fail to complete the hue improving treatment. Temperatures exceeding 350° C., on the other hand, happen to accelerate the decomposition reaction. Temperatures outside the above range are therefore not preferred.

It is also possible to carry out the hue improving treatment by hydro-refining after the separation of the hydrodewaxed oil by distillation. The refined mineral oil is, similar to the above-described treatment, subjected to solvent extraction refining as needed under the conditions of a raffinate yield of 60 to 90 vol. % beta solvent which selectively extracts an aromatic hydrocarbon.

Production of a low pour point oil

From the refined mineral oil so obtained, the heavy fraction is removed, because the hydrodewaxing treatment effectively acts on the wax content of a lighter fraction and in comparison, the dewaxing of the heavy fraction does not proceed smoothly. The pour point of the lighter fraction shows a drastic decrease, while that of the heavy fraction becomes relatively high. As the lighter fraction, that up to the point of 80% distillation, preferably 70% distillation, more preferably 66% distillation are subjected to fractional distillation. Inclusion of the lighter fraction other than that up to the point of 80% distillation causes a drastic increase in the pour point and is therefore not preferred.

Upon fractional distillation, the fraction of 240° C. or lower contained, if any, in the refined mineral oil is removed by stripping. It does not matter whether the fractional distillation and stripping are carried out simultaneously. When a long-chain alkylbenzene is added, it is added in an amount of 10 to 40 parts by weight.

Based on the examples of the present invention, the present invention will hereinafter be described more specifically and advantages of the present invention will be exemplified. It should however be understood that the present invention is not deemed to be limited thereto.

EXAMPLE 1

Raw material mineral oil

The fraction which had been separated from an arabiarite crude oil by topping and distillation under reduced pressure in a conventional manner and had a boiling point ranging from 250 to 450° C. and kinematic viscosity of 9.0 $mm^2/s$ (40° C.) was used as a raw material.

Production of a refined mineral oil

The raw material obtained above was hydrodewaxed under the below-described conditions, and immediately after that, the hydrodewaxed oil was subjected to hydro-refining treatment. From thus treated oil, the lighter fraction (240° C. or lower) was removed, whereby a refined mineral oil was obtained. The refined mineral oil had a kinematic viscosity of 8.2 $mm^2/s$ (40° C.) and a pour point of −32.5° C.

Hydrodewaxing treatment

As a catalyst, a pentasil type zeolite (silica-alumina ratio: 41.5) was used and hydrodewaxing was carried out under the conditions of a hydrogen pressure of $8.9\times10^6$ Pa (about 90 $kgf/cm^2$ in terms of gauge pressure), a temperature of 371° C. and LHSV of 1.5 $h^{-1}$. The resulting oil was provided for the hydro-refining treatment as is without separation.

Hydro-refining treatment

In the presence of a catalyst having 1.0 mass % of nickel and 12.0 mass % of molybdenum supported on a silica-alumina carrier, hydro-refining treatment was carried out under the conditions of a hydrogen pressure of $8.9\times10^6$ Pa (about 90 $kgf/cm^2$ in terms of a gauge pressure), a temperature of 339° C., and LHSV of 0.6 $h^{-1}$. The desulfurization ratio was 99%, while the denitrification ratio was 99%. As a result of the distillation of the lighter fraction (240° C. or lower) by stripping, the total decomposition ratio due to the hydrowaxing and hydro-refining treatments was 17% (the decomposition ratio due to the hydro-refining treatment was 2%).

Production of a lower pour point oil

The refined mineral oil so obtained was subjected to fractional distillation and a 0 to 30% fraction was obtained. The resulting fraction had a kinematic viscosity of 5:1 $mm^2/s$ (40° C.) and a pour point of −52.5° C.

EXAMPLE 2

The refined mineral oil obtained in Example 1 was subjected to fractional distillation and a 30 to 66% fraction was obtained. The resulting oil had a kinematic viscosity of 8.0 $mm^2/s$ (40° C.) and a pour point of −42.5° C.

EXAMPLE 3

The refined mineral oil obtained in Example 1 was subjected to fractional distillation and a 30 to 70% fraction was obtained. The resulting oil had a kinematic viscosity of 8.9 $mm^2/s$ (40° C.) and a pour point of −40.0° C.

COMPARATIVE EXAMPLE 1

The refined mineral oil obtained in Example 1 was subjected to fractional distillation and a 66 to about 99% fraction was obtained. The resulting mineral oil fraction had a kinematic viscosity of 13.3 $mm^2/s$ (40° C.) and a pour point of −27.5° C.

EXAMPLE 4

Raw material mineral oil

From an arabiarite crude oil, the fraction having a boiling point ranging from 350 to 550° C. was separated by topping and distillation under reduced pressure in a conventional manner. The resulting fraction was subjected to solvent extraction, whereby a raw material having a kinematic viscosity of 165 $mm^2/s$ (40° C.) was obtained.

Production of a refined mineral oil

Immediately after the above-described raw material oil was hydrodewaxed, the resulting oil was subjected to hydro-refining treatment under the below-described conditions. From the thus treated oil, the lighter fraction (340° C. or lower) was removed, whereby a refined mineral oil was obtained. The refined mineral oil had a kinematic viscosity of 154 $mm^2/s$ (40° C.) and a pour point of −30° C.

Hydrodewaxing treatment

In the presence of a pentasil type zeolite (silica-alumina ratio: 41.5) as a catalyst, hydrodewaxing treatment was carried out under the conditions of a hydrogen pressure of $8.9\times10^6$ Pa (about 90 $kgf/cm^2$ in terms of gauge pressure), a temperature of 375° C. and LHSV of 1.0 $h^{-1}$. The resulting oil was provided as was for the hydro-refining treatment without separation.

Hydro-refining treatment

In the presence of a catalyst having 1.0 mass % of nickel and 12.0 mass % of molybdenum supported on a silica-alumina carrier, hydro-refining treatment was carried out under the conditions of a hydrogen pressure of $8.9\times10^6$Pa (about 90 $kgf/cm^2$ in terms of a gauge pressure), a temperature of 360° C., and LHSV of 0.5 $h^{-1}$. The desulfurization ratio was 99%, while the denitrification ratio was 99%. As a result of the distillation of the lighter fraction (340° C. or lower) by stripping, the total decomposition ratio due to the hydrodewaxing and hydro-refining treatments was 15% (the decomposition ratio due to the hydro-refining treatment was 2%).

Production of a lower pour point oil

The refined mineral oil so obtained was subjected to fractional distillation and a 0 to 30% fraction was obtained. The resulting oil fraction had a kinematic viscosity of 80 $mm^2/s$ (40° C.) and a pour point of −40° C.

EXAMPLE 5

The refined mineral oil of Example 4 was subjected to fractional distillation and a 30 to 62% fraction was obtained. The resulting mineral oil fraction had a kinematic viscosity of 142 $mm^2/s$ (40° C.) and a pour point of −35° C.

COMPARATIVE EXAMPLE 2

The refined mineral oil of Example 4 was subjected to fractional distillation and a 62 to about 99% fraction was obtained. The resulting mineral oil fraction had a kinematic viscosity of 267 $mm^2/s$ (40° C.) and a pour point of −25° C.

According to the present invention, an oil having a lower pour point can be produced without severer hydrodewaxing conditions, which makes it possible to facilitate the production of a low pour point oil and at the same time to largely contribute to a production cost reduction.

While the invention has been described in detail and with reference to specfic examples thereof, it will be apparent to one skilled in the art that various changes and modifications can be made therein without departing from the spirit and scope thereof.

What is claimed is:

1. A process for producing a low pour-point oil, which comprises hydrodewaxing a mineral oil fraction, which has been separated from a crude oil by distillation and has a boiling point ranging from 250 to 600° C., at a temperature range of from 250° C. to 500° C. in the presence of a zeolite catalyst to obtain a hydrodewaxed fraction; and separating a lighter fraction from the hydrodewaxed fraction by a fractional distillation that obtains up to an 80% fraction of the hydrodewaxed fraction.

2. A process for the preparation of a low pour-point oil, which comprises hydrogenating a mineral oil fraction, which has been separated from a crude oil by distillation and has a boiling point ranging from 250 to 600° C., at a temperature range of from 320° C. to 380° C. in the presence of a hydro-refining catalyst; and hydrodewaxing the resulting fraction at a temperature range of 250° C. to 500° C. in the presence of a zeolite catalyst; subjecting the hydrodewaxed fraction to hue improving treatment by hydrogenating the hydrodewaxed fraction at a temperature range of from 250° to 350° C. in the presence of a hydro-refining catalyst to obtain a hydrogenated hydrodewaxed fraction; and separating from the hydrogenated hydrodewaxed fraction a lighter fraction by a fractional distillation that obtains up to an 80% fraction of the hydrogenated hydrodewaxed fraction.

3. A process for producing a low pour-point oil, which comprises hydrodewaxing a mineral oil fraction, which has been separated from a crude oil by distillation and has a boiling point ranging from 250 to 600° C., at a temperature range of from 250° C. to 500° C. in the presence of a zeolite catalyst; hydrogenating the resulting fraction at a temperature range of from 320° C. to 380° C. in the presence of a hydro-refining catalyst to obtain hydro-refined product; and separating a light fraction from the hydro-refined product by a fractional distillation that obtains up to an 80% fraction of the hydro-refined product.

4. A process according to claim 1, wherein the fractional distillation obtains up to a 70% fraction of the hydrodewaxed fraction.

5. A process according to claim 1, wherein the fractional distillation obtains up to a 60% fraction of the hydrodewaxed fraction.

6. A process according to claim 2, wherein the fractional distillation obtains up to a 70% fraction of the hydrogenated hydrowaxed fraction.

7. A process according to claim 2, wherein the fractional distillation obtains up to a 60% fraction of the hydrogenated hydrowaxed fraction.

8. A process according to claim 3, wherein the fractional distillation obtains up to a 70% fraction of the hydro-refined product.

9. A process according to claim 3, wherein the fractional distillation obtains up to a 60% fraction of the hydro-refined product.

10. A process according to claim 1, wherein the fraction distillation obtains up to a 30% fraction of the hydrowaxed fraction.

11. A process according to claim 1, wherein the fractional distillation obtains a 30 to 66% fraction of the hydrowaxed fraction.

12. A process according to claim 1, wherein the fractional distillation obtains a 30 to 70% fraction of the hydrowaxed fraction.

* * * * *